US005752278A

United States Patent [19]

Gunn

[11] Patent Number: 5,752,278

[45] Date of Patent: May 19, 1998

[54] LOW FRICTION APPAREL

[76] Inventor: Robert T. Gunn, 360 E. 65th St., Apartment 11E, New York, N.Y. 10021

[21] Appl. No.: 735,731

[22] Filed: Oct. 23, 1996

Related U.S. Application Data

[63] Continuation of Ser. No. 217,490, Mar. 24, 1994, Pat. No. 5,590,420.

[51] Int. Cl.[6] ..... A41D 1/00

[52] U.S. Cl. ..... 2/69; 2/239; 2/243.1

[58] Field of Search ..... 2/239, 69, 243.1, 2/902, 904, 168, 158, 161.7, 161.1, 167, 46, 48, 51, 50, 81, 114, 83, 79, 80; 36/138, 43, 44, 35, 12 R

[56] References Cited

U.S. PATENT DOCUMENTS

| | | | |
|---|---|---|---|
| 3,328,100 | 6/1967 | Spokes et al. . | |
| 3,590,881 | 7/1971 | Van Amburg . | |
| 3,813,695 | 6/1974 | Podell, Jr. et al. . | |
| 3,844,826 | 10/1974 | Buchner et al. . | |
| 4,074,512 | 2/1978 | Matt . | |
| 4,152,784 | 5/1979 | McGalliard . | |
| 4,153,980 | 5/1979 | Moertel | 24/205.16 |
| 4,195,362 | 4/1980 | Rolando . | |
| 4,261,061 | 4/1981 | McAlvage | 2/239 |
| 4,296,499 | 10/1981 | Patterson et al. | 2/239 |
| 4,438,531 | 3/1984 | Long et al. . | |
| 4,494,247 | 1/1985 | Kelly . | |
| 4,550,446 | 11/1985 | Herman | 2/239 |
| 4,572,174 | 2/1986 | Eilender et al. | 128/149 |
| 4,805,240 | 2/1989 | Siqveland . | |
| 4,843,844 | 7/1989 | Hursh et al. . | |
| 4,864,669 | 9/1989 | Jones | 5/434 |
| 4,881,276 | 11/1989 | Swan . | |
| 4,922,551 | 5/1990 | Anthes | 2/79 |
| 4,967,494 | 11/1990 | Johnson . | |
| 5,123,113 | 6/1992 | Smith | 2/2 |
| 5,260,360 | 11/1993 | Mrozinski et al. . | |
| 5,271,211 | 12/1993 | Newman . | |
| 5,323,815 | 6/1994 | Barbeau et al. . | |
| 5,376,441 | 12/1994 | Wu et al. . | |
| 5,385,694 | 1/1995 | Wu et al. . | |
| 5,590,420 | 1/1997 | Gunn | 2/69 |

FOREIGN PATENT DOCUMENTS

| | | |
|---|---|---|
| 70407/74 | 1/1976 | Australia . |
| 17452/76 | 3/1978 | Australia . |
| 22938/77 | 9/1978 | Australia . |
| 77340/91 | 1/1992 | Australia . |
| WO 95/17107 | 6/1995 | WIPO . |

*Primary Examiner*—Gloria M. Hale

*Attorney, Agent, or Firm*—Frommer Lawrence & Haug, LLP

[57] ABSTRACT

The present invention relates to apparel, such as clothing, footwear, fabrics, and the like, which incorporates fabrics or chemicals having a low coefficient of friction either overall or in specific areas of the apparel that will minimize the development of blisters, callouses, and irritation of the skin. The invention also includes methods for producing this low friction apparel.

23 Claims, 5 Drawing Sheets

LOW FRICTION APPAREL

This application is a continuation application Ser. No. 08/217,490, filed Mar. 24 , 1994 now U.S. Pat. No. 5,590, 420.

BACKGROUND OF INVENTION

This invention relates to low friction apparel and methods for producing same, wherein apparel is defined as clothing, footwear, fabrics, and the like. More particularly, the invention relates to low friction apparel which incorporates fabrics or chemicals having a low coefficient of friction either overall or in specific areas of the apparel that will minimize the development of blisters, callouses, and irritation of an apparel wearer's body surface. The invention also includes methods for producing the low friction apparel and methods for using a low friction material to reduce the coefficient of friction of a finished article of apparel or the like to reduce irritation.

Apparel is made out of many materials, natural and man-made. They include cotton, wool, silk, linen, leather, vinyl, nylon—polyamides and polyamide co-polymers, LYCRA SPANDEX™ in different filament configurations, orlon polyvinylidene fluoride, such as KYNAR™, polyester, for example, polyethylene terepthalate, glycol modified polyesters, such as PETG, KODURA™, rayon, orlon cellulosic fiber blends, and the like, as well as blends of the above.

Of courses apparel, either directly or indirectly, contacts the body surface of the wearer. The movement of the wearer causes frictional contact between the wearer's body surface and the apparel. This frictional contact can cause irritation, blisters, and callouses. This frictional contact is particularly a problem in sporting apparel wherein the formation of irritations, blisters, and callouses is exacerbated by the rapid and/or repetitious body movements related to the particular activity. Additionally, it is noted that most apparel has specific areas of high body surface/apparel contact which produces a majority of the irritations, blisters, and callouses.

It would be highly desirable to have apparel which has an overall low coefficient of friction or which has material having a low coefficient of friction in areas of high body surface/apparel contact such that irritations, blisters, and callouses are avoided or minimized.

SUMMARY OF THE INVENTION

It is a principle object of the invention to provide low friction apparel which avoids or minimizes the development of irritations, blisters, and callouses.

A further object of the invention is to provide a method for producing low friction apparel by chemically treating the fibers or yarn or the like of the material from which the apparel is made prior to or after producing the material.

Another object of the invention is to provide a method for producing low friction apparel by incorporating low friction yarns, fibers or material into the fabric from which the apparel is made.

Yet another object of the invention is to provide a method for producing low friction apparel by applying chemicals to impart a low friction coefficient directly to the fabric or apparel either overall or in areas of high body surface/apparel contact.

DETAILED DESCRIPTION OF THE INVENTION

Figure 1:
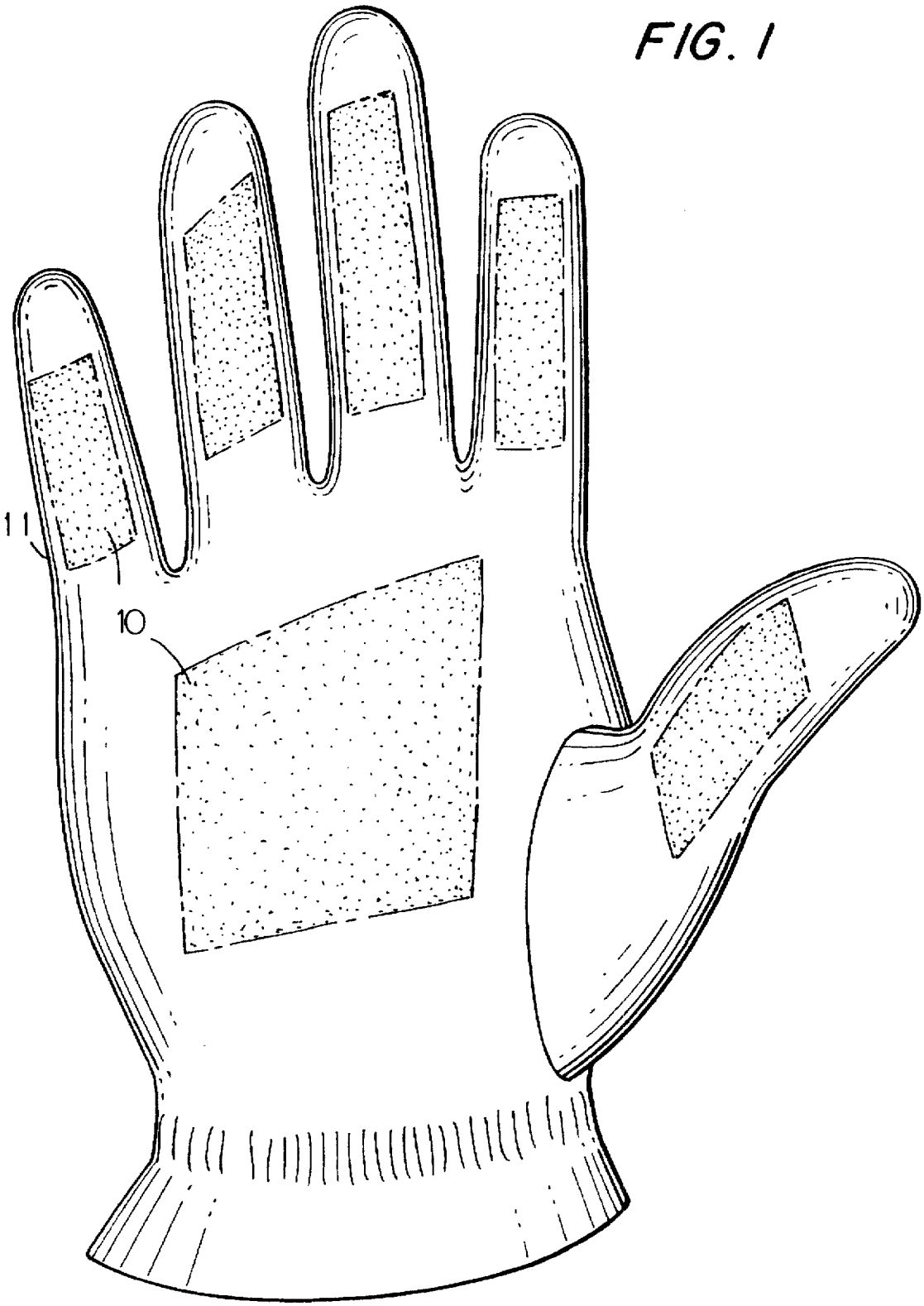
FIG. 1 is a front elevational view of a preferred glove of the present invention.
Figure 2:
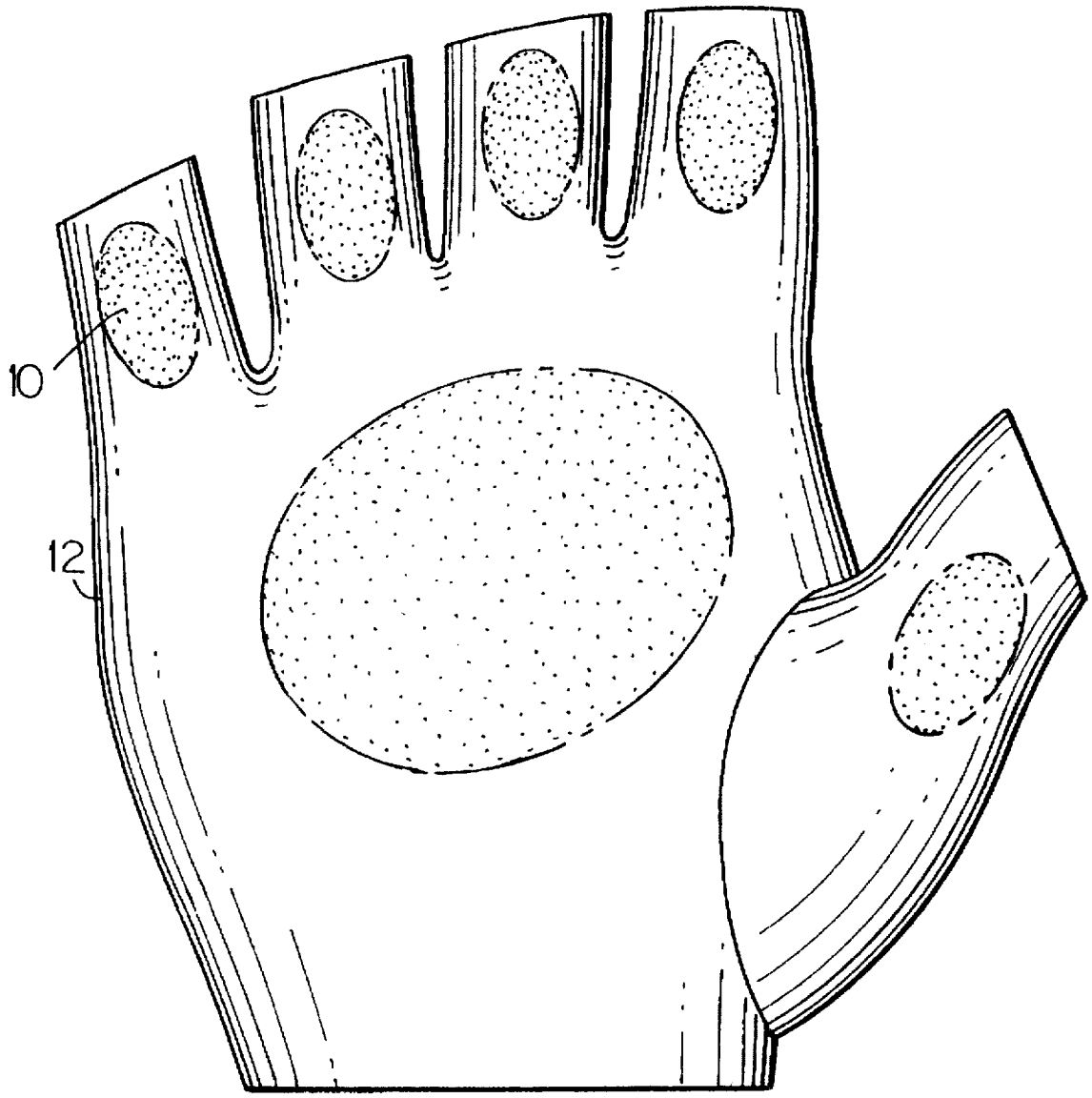
FIG. 2 is a front view of an alternative embodiment of the glove of the present invention.

As indicated above, the present invention provides low friction apparel to avoid or minimize irritations, blisters, and callouses that can result from abrasive contact between a wearer's body surface and the apparel. Low friction apparel can be made with low friction materials. (10, FIGS. 1–9) These low friction materials can be fibers which inherently have a low coefficient of friction which are incorporated into the material either alone or in combination with other materials; low friction chemicals which can be applied directly to the finished fibers, material, or apparel to impart low friction properties; fibers which are treated with low friction chemicals then woven into the material either alone or in combination with other material; or any combination of the above. These low friction materials (10, FIGS. 1–9) can be incorporated into the entire piece of apparel (17, FIG. 5; 18, FIG. 7; 20, FIG. 6) or in specific high body surface/apparel contact areas (11, FIG. 1; 12, FIG. 2; 13, FIG. 3; 14, FIG. 4; 25, FIG. 4A; 35, FIG. 4B; 45, FIG. 4C; 55, FIG. 4D; 19, FIG. 8; 21, FIG. 9).

Some material fibers inherently have a low coefficient of friction. These fibers include, but are not limited to, silicone, graphite, TEFLON™, KYNAR™, boron, polypropylene, polyethylene, and GORTEX™. These materials can be incorporated directly into the apparel either overall or in specific high body surface/appeal contact areas to produce low friction apparel.

Chemicals can be used to treat material fibers or finished materials that do not inherently have a low coefficient of friction in order to impart a low coefficient of friction. Additionally, this chemical treatment can be used with materials which do inherently have a low coefficient of friction in order to impart an even lower coefficient of friction. This chemical treatment is incorporated into the material such that it is of a non-temporary nature. Most preferably, this chemical treatment is incorporated into the material such that it is functional substantially over the lifetime of the treated article. These chemicals include, but are not limited to, silicone, silicone co-polymers, silicone elastomers, polytetra fluoroethylene, homopolymers and copolymers such as TEFLON™, graphite, and the like, as well as any combination of the above chemicals. The fibers can be treated with these chemicals by coextrusion when producing the fibers, blending with the fibers after production, adding in a bath form or spraying onto the fiber or material, or similar techniques. The finished material can be treated with these chemicals by adding in a bath form or spraying onto the material, or similar techniques.

In a typical application of the invention, a fiber, yarn or fabric or finished article (such as apparel) is treated with the low coefficient of friction material to reduce the coefficient of friction of the treated fiber, yarn, fabric or article to one which is below the coefficient of friction of the untreated fiber, yarn, fabric or finished article.

It is preferred that the coefficient of friction of the treated object be less than about 80%, preferably less than about 60% and most preferably less than about 50% of the coefficient of friction of the untreated object.

If the low friction material is incorporated into the finished article or fabric by weaving a low friction fiber or yarn into the article or fabric, the low friction fiber or yarn can be incorporated into amounts ranging from 5% to 100% by weight of the treated area. Preferably, the fiber or yarn is incorporated in amounts between 30 and 70% by weight of the treated area. Most preferably, these amounts are 30 to 50%, by weight.

The addition of the low friction material to the fiber, yarn, fabric or article can also be useful to wick away moisture from the skin to help guard against irritation, as well as wetness.

It is preferred that areas of objects treated are typically areas which would ordinarily come in contact with the skin during use. Furthermore, it would be preferred that areas treated be those areas subject to imparting frictional movement against the skin during use.

It is preferred also that the coefficient of friction between the treated area of the object and the body surface to be reduced to below about 0.9. Most preferably, the coefficient of friction is reduced to below about 0.6.

The following examples are set forth to illustrate specific embodiments of the invention.

EXAMPLE 1

Figure 3:
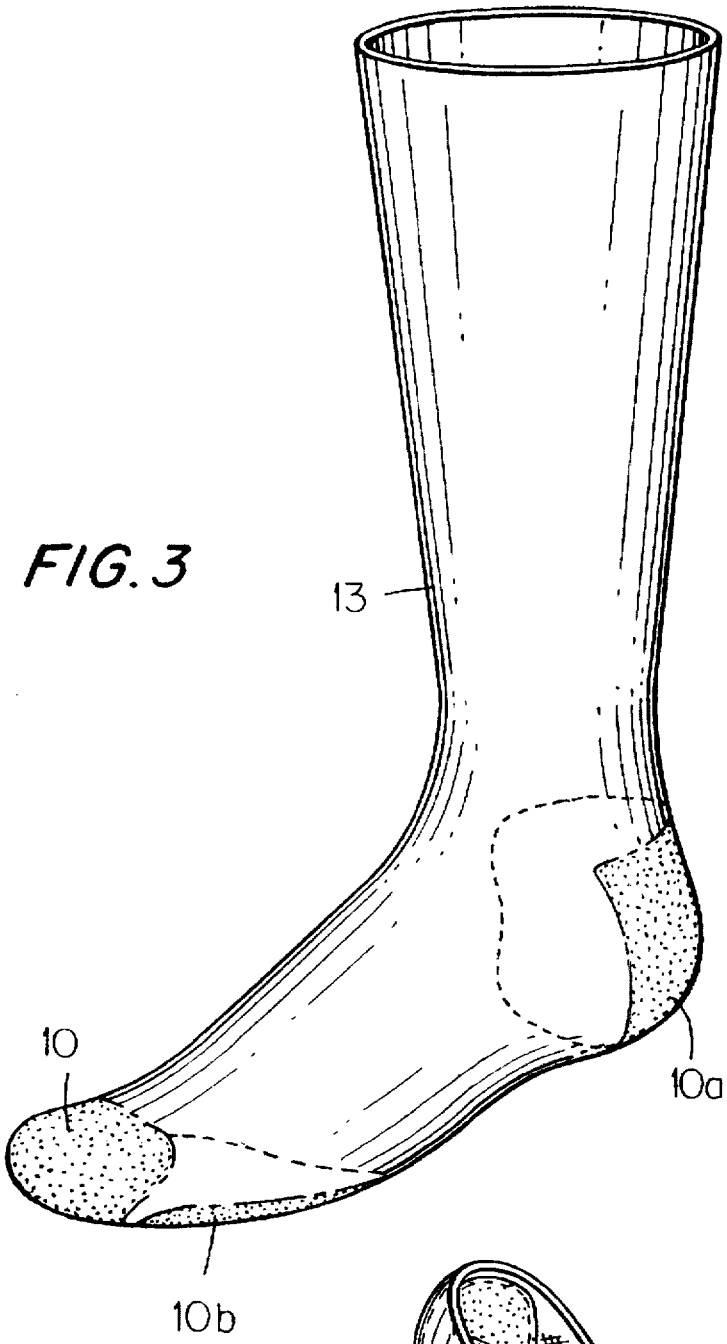
FIG. 3 is a perspective view of a sock or hosiery of the present invention.
Figure 4:
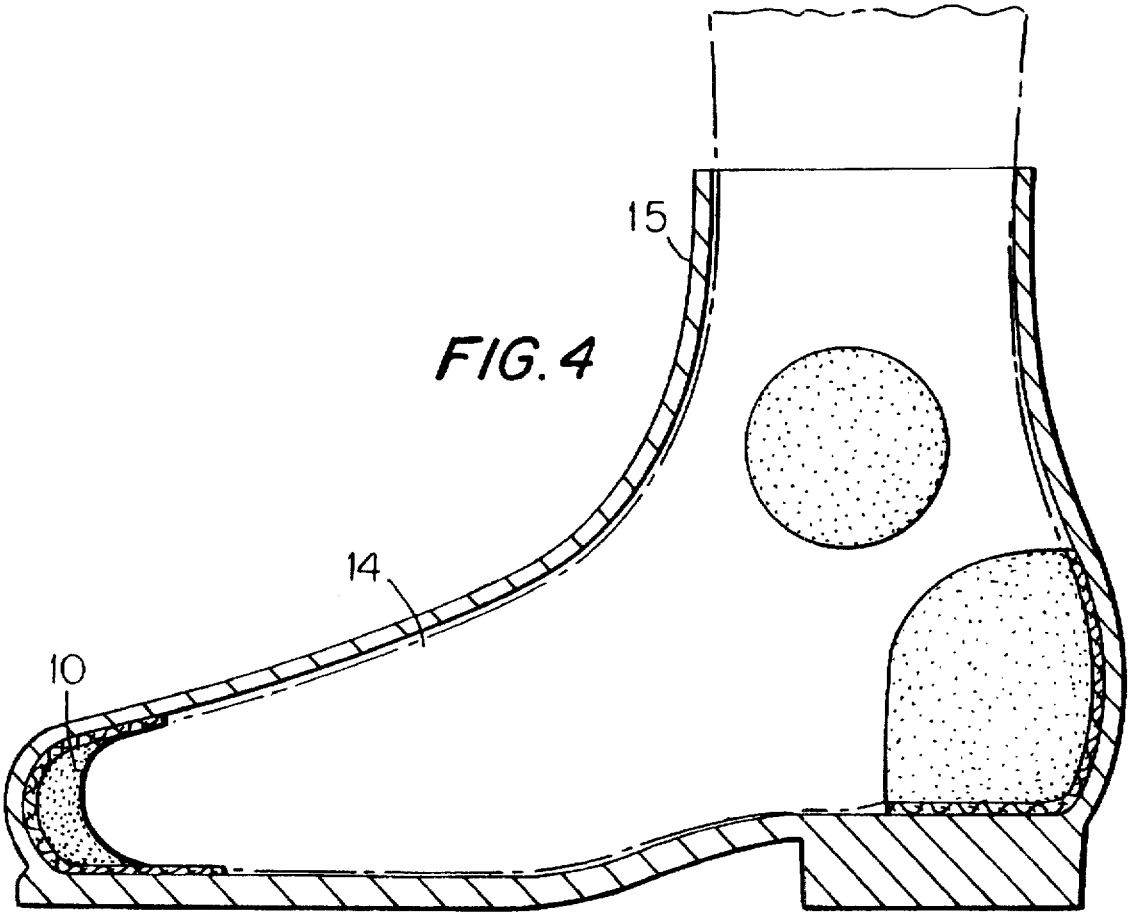
FIG. 4 is a cross-sectional view of a foot insert of the present invention.
Figure 4A:
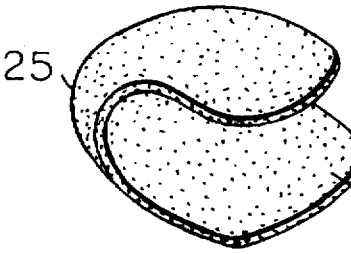
FIG. 4A is a perspective view of the toe insert of the present invention for insertion into the footwear or onto the foot surface of the user.
Figure 4B:
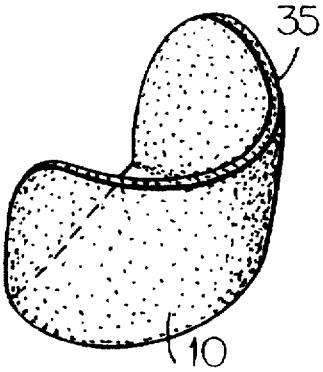
FIG. 4B is a perspective view of the heel cup insert of the present invention for insertion into the footwear or onto the foot surface of the user.
Figure 4C:
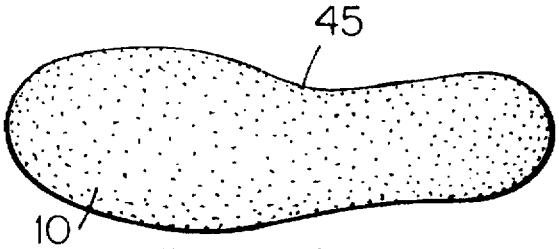
FIG. 4C is a bottom plan view of a shoe insert of the present invention for insertion into the footwear or onto the foot surface of the user.
Figure 4D:
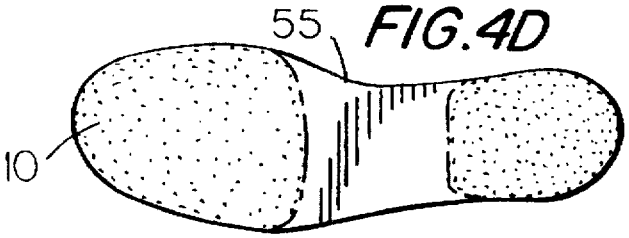
FIG. 4D is an alternative bottom plan view of an alternative shoe insert of the present invention for insertion into the footwear or onto the foot surface of the user.

In one embodiment, low friction socks or hosiery can be produced by incorporating low friction material overall or in specific high contact areas such as in the heel area (10*a*, FIG. 3), the area around the pad of the sole of the foot (10*b*, FIG. 3), the area extending from the pad of the foot to the right and left sides of the foot, in the region where the foot is the widest, and the area around the toes (10, FIG. 3). Areas of the foot which contact laces, buckles or straps are also contact areas where protection would be utilized. The low friction material can also be incorporated to the outside of the sock which reduces friction between the sock and the outer foot apparel, such as a shoe. The low friction material can be incorporated to the inside of the sock which reduces friction between the wearer's foot and the sock. Additionally, low friction material can be incorporated to both inside and outside of the sock which, of course, simultaneously reduces friction between the sock and the outer footwear, and the wearer's foot and the sock.

EXAMPLE 2

In another embodiment, outer footwear such as a shoe, sneaker, boot, ski boot, sandal, slipper and the like, can have low friction material incorporated into the outer footwear fabric lining at high body surface/apparel contact areas thereby reducing friction between the wearer's foot or sock and the footwear. It is also noted that in footwear which has no fabric lining, the footwear material itself, such as leather, can be treated with low friction coefficient chemicals in high body surface/apparel contact areas (10.21, FIG. 9) to have a similar result.

Figure 9:
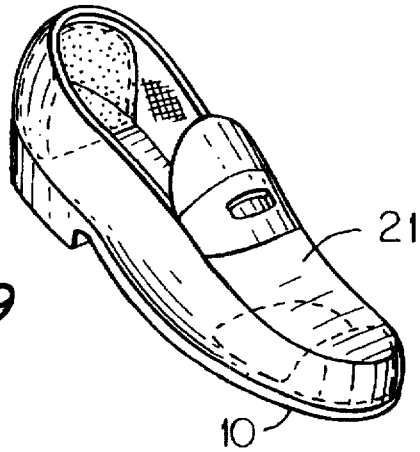
FIG. 9 is a perspective view of a footwear of the present invention.

The low friction material is particularly useful in areas where the product would rub against the skin and cause irritation, blisters or callouses. In feet, these areas would be the heel, sole, the pads of the feet at the wide portion of the foot as shown in FIG. 9, or the top of the foot which contacts laces, buckles or straps.

EXAMPLE 3

Figure 8:
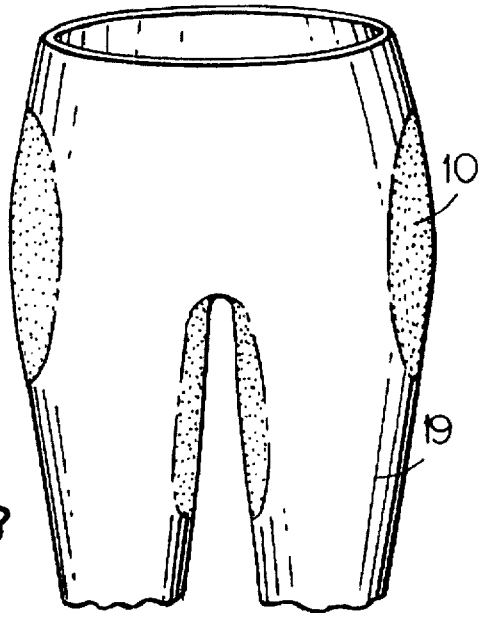
FIG. 8 is a perspective view of an athletic wear of the present invention.

In a further embodiment, sporting apparel, such as warm-up pants, shorts, jogging suits, bicycle pants, wet suits, work pants and the like, can have low friction material incorporated into high body surface/apparel contact areas such as the groin area and along the seams, such as the inner thigh seam, to avoid rubbing and irritations (10, FIG. 8). Additionally, sporting apparel, such as sport shirts, warm-up shirt, and the like, can have low friction material incorporated into high body surface/apparel contact areas such as the neck and underarm areas to also avoid rubbing and irritations.

EXAMPLE 4

In yet another embodiment, work and sport gloves such as gloves used with tools, golf clubs, baseball bats, polo mallets, and tennis, squash and racquetball racquets, can have low friction material incorporated the glove (10, 11, FIG. 1; 10, 12, FIG. 2) at high body surface/apparel contact areas to avoid blisters and callouses on the hands.

EXAMPLE 5

The low friction material can be utilized in footwear inserts (10, 14, 15, FIG. 4; 10, 25, FIG. 4A; 10, 35, FIG. 4B; 10, 45, FIG. 4C; 10, 55, FIG. 4D) and other devices made to fit in traditional footwear that will help avoid blisters and callouses by reducing friction of the foot against the pressure areas of footwear such as heel cushions (10, 25, FIG. 4A), insoles,(10, 45, FIG. 4C; 10, 55, FIG.4D), orthotics, cushions and other pads (bandages).

EXAMPLE 6

Figure 5:
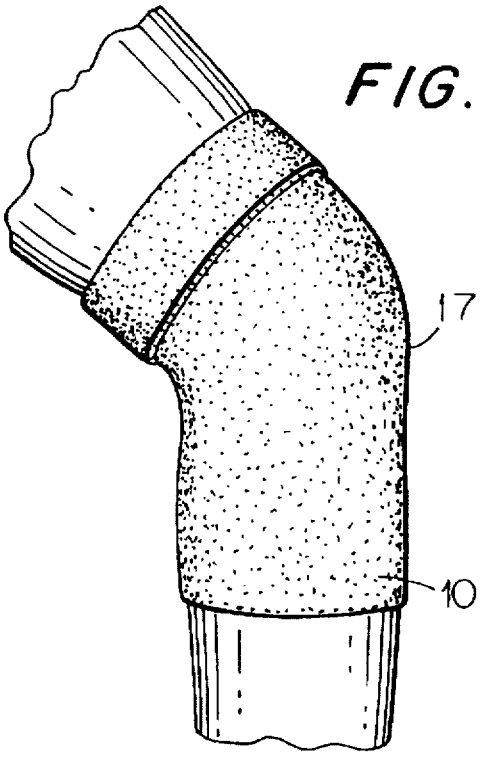
FIG. 5 is a perspective view of a knee bandage of the present invention.
Figure 6:
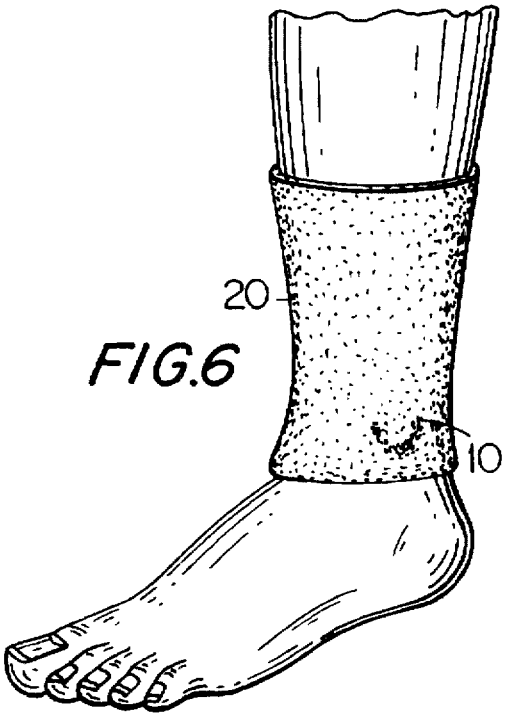
FIG. 6 is a perspective view of an ankle bandage of the present invention.
Figure 7:
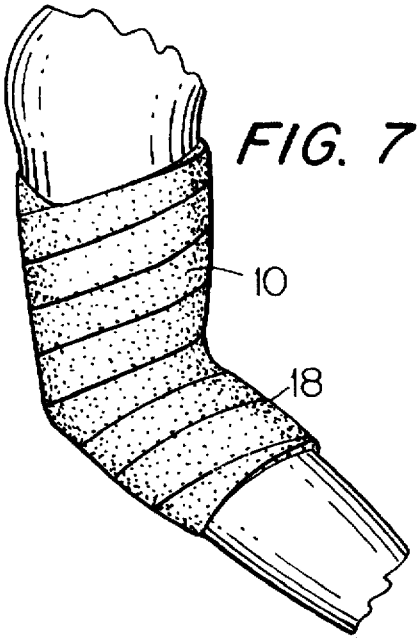
FIG. 7 is a perspective view of an elbow bandage of the present invention.

The low friction material can also be used in bandages and wraps which support torn and sore muscles, ligaments and joints and as linings for casts(10, 7, FIG. 5; 10, 20, FIG. 6; 10, 18, FIG. 7).

EXAMPLE 7

The low friction material can be incorporated into covers for sporting equipment and tools and other devices that one uses that could cause irritation, blisters, callouses or soreness from friction.

Handles of baseball bats, handles of tennis and racquetball racquets, shovels, picks, construction and garden tools, hammers, screwdrivers, pliers, etc, handles of ski poles, fishing rods, water ski rope grips and towing ropes, golf clubs, archery bows, bicycle seats, car seats and back seats, weights and exercise equipment, etc., are all areas which can be incorporated with the low friction material.

It is understood that the invention is not limited to human apparel. The invention can also be used in horse blankets, pet apparel, and the like.

It is also understood that the invention is not restricted to the detailed description of the invention, which may be modified without departure from the accompanying claims.

What is claimed is:

1. An article of clothing having a treated area and an untreated area in contact with a body surface of a user, wherein the treated area incorporates a chemically treated low coefficient of friction material ranging from 5% to 100% by weight of the treated area, which is of a non-temporary nature, into the clothing to reduce the coefficient of friction of the treated area to one which is below the coefficient of friction of the untreated area.

2. The article of claim 1, wherein the low coefficient of friction material is a polytetrafluoroethylene yarn or fiber knitted into the treated area of the clothing.

3. The article of claim 2, wherein the low coefficient of friction material imparts a coefficient of friction to the treated area which is less than 80% of the coefficient of friction of the untreated area of the clothing.

4. The article of claim 3, wherein the coefficient of friction of the treated area is less than about 60% of the coefficient of friction of the untreated area of the clothing.

5. The article of claim 4, wherein the coefficient of friction of the treated area is less than about 50% of the coefficient of friction of the untreated area of the clothing.

6. The article of claim 1, wherein the low coefficient of friction material is incorporated in amounts between 30 and 70% by weight of the treated area.

7. The article of claim 6, wherein the low coefficient of friction material is incorporated in amounts between 30% and 50% by weight of the treated area.

8. The article of claim 1, wherein the low coefficient of friction material is selected from the group consisting of silicone, silicone copolymers, silicone elastomers, polytetrafluoroethylene, homopolymers and copolymers thereof, graphite, boron, polypropylene and polyethylene.

9. The article of claim 1, wherein the treated area includes those areas subject to imparting frictional movement against the skin during use.

10. The article of claim 1, where the treated area includes at least an underarm area, portions of the front torso area, portions of the back torso area, neck area, inner thigh area, crotch area, heel area, sole area, pads of a feet at the wide portion of the foot, toe area, or top of the foot which contacts laces, buckles, straps.

11. The article of claim 1, wherein the coefficient of friction between the treated area of the clothing and the body surface is less than about 0.6.

12. The article of claim 1, wherein the article of clothing is a sock, hosiery, sporting apparel, or glove.

13. The article of claim 1, wherein the article of clothing is footwear, footwear lining, or footwear insert.

14. The article of claim 13, wherein the footwear is a shoe, sneaker, boot, ski boot, sandal, or slipper.

15. The article of claim 13, wherein the footwear insert is a heel cushion, toe insert, sole insoles, orthotics, cushion and pads adapted to a foot surface of the footwear.

16. The article of claim 12, wherein the sports apparel is warm-up pants, shorts, jogging suits, bicycle pants, wet suits, work pants, or sports shirts.

17. A method for producing an article of clothing having a treated area and untreated area in contact with a body surface of a user, wherein frictional contact between the treated area and the body surface of the user is reduced, comprising the steps of:

chemically treating a yarn with a non-temporary low coefficient of friction material;

incorporating the yarn into the treated area in amounts from 5% to 100% by weight of the treated area, wherein the treated area reduces frictional contact against the body surface of a user.

18. The method of claim 17, wherein the step of incorporating the yarn into the treated area of the article of clothing comprises knitting the yarn into the treated area.

19. The method of claim 18, wherein the treated area includes at least an underarm area, portions of a front torso, portions of a back torso area, neck area, inner thigh area, crotch area, heel area, sole area, pads of a feet at the wide portion of the foot, toe area, or top of the foot which contacts laces, buckles, or straps.

20. The method of claim 17, wherein the low coefficient of friction material is selected from the group consisting of silicone; silicone copolymers; silicone elastomers; polytetrafluoroethylene; homopolymers and copolymers thereof; graphite; boron; polypropylene and polyethylene.

21. The method of claim 17, wherein the coefficient of friction of the treated area is less than about 80% of the coefficient of friction of an untreated area of the article of clothing.

22. The method of claim 21, wherein the coefficient of friction of the treated area is less than about 60% of the coefficient of friction of the untreated area of the article of clothing.

23. The method of claim 22, wherein the coefficient of friction of the treated area is less than about 50% of the coefficient of friction of the untreated area of the article of clothing.

* * * * *